United States Patent [19]

Reed, Jr.

[11] 3,968,160

[45] July 6, 1976

[54] PREPARATION OF 1,2,3-TRIS[1,2-BIS(DIFLUORAMINO)ETHOXY]PROPANE

[75] Inventor: Samuel F. Reed, Jr., Huntsville, Ala.

[73] Assignee: Rohm and Haas Company, Philadelphia, Pa.

[22] Filed: Apr. 27, 1964

[21] Appl. No.: 363,680

[52] U.S. Cl. ..... 260/584 C; 149/109.4

[51] Int. Cl.[2] ..... C07C 85/00

[58] Field of Search ..... 260/584, 584 C

[56] References Cited

UNITED STATES PATENTS 3,700,708 10/1972 Petry ..... 260/584 C X

*Primary Examiner*—Leland A. Sebastian

EXEMPLARY CLAIM

1. A method for the preparation of 1,2,3-tris[1,2-bis(difluoramino)ethoxy]-propane which comprises reacting tetrafluorohydrazine and trivinoxypropane at a temperature of about O° to about 120° C.

5 Claims, No Drawings

PREPARATION OF 1,2,3-TRIS[1,2-BIS(DIFLUORAMINO)ETHOXY]-PROPANE

This invention deals with a method for the preparation of a derivative of trivinoxypropane, namely 1,2,3-tris[1,2-bis-(difluoramino)ethoxy]-propane.

The present method concerns the reaction between tetrafluorohydrazine and trivinoxypropane to produce 1,2,3-tris-[1,2-bis(difluoramino)ethoxy]-propane.

The reaction is conducted in the range of about 0° to 120° C., preferably 20° to 100° C. At least at the beginning, the reaction is strongly exothermic in nature and, therefore, it is preferred to add slowly the trivinoxypropane or at a rate at which it substantially reacts. The reaction may be conducted at atmospheric, sub-atmospheric or super-atmospheric pressure as desired. It is conveniently conducted in the range of 500 mm. of mercury up to about 600 psig. It is preferred, in most instances, to use pressures above atmospheric.

The reaction is preferably conducted in the presence of an inert volatile organic solvent, preferably one that is a solvent for both the desired product as well as the reactant. There may advantageously be employed aromatic and aliphatic hydrocarbons, chlorinated hydrocarbons, ethers and ketones. Typical embodiments of the solvents include diethyl ether, dipropyl ether, pentane, hexane, chloroform, carbon tetrachloride, methylene chloride, benzene, toluene, xylene and acetone. It is preferred to use the lower boiling solvents in order to make isolation of the desired product more convenient.

At the conclusion of the reaction, the product is readily separated by removal of the solvent, preferably by stripping at reduced pressure. The product is 1,2,3-tris[1,2-bis-(difluoramino)ethoxy]-propane, which is identifiable by elemental analysis and infrared examination. The product, 1,2,3-tris[1,2-bis(difluoramino)ethoxy]-propane, is a clear, nearly waterwhite liquid.

The product is useful as a high energy plasticizer for propellant systems and can conveniently be used in the range of 20 to 40% by weight of the total propellant mix.

The present invention may be more fully understood by the following examples which are offered by way of illustration and not by way of limitation:

EXAMPLE I

To a glass Aerosol tube of 100 ml. capacity is introduced 5.14 g. (0.03 mole) of trivinoxypropane in 30 ml. of $CCl_4$. The tube is then placed in position in a high pressure manifold, degassed thoroughly under vacuum, flushed and degassed three times with nitrogen. Tetrafluorohydrazine is introduced into the reactor tube to give an initial pressure of 84 psig. An initial pressure drop is observed which is due to solvent absorption. After recharging to 84 psig. with tetrafluorohydrazine, the mixture is heated to 58° C. During the next eight hours, the tetrafluorohydrazine pressure is maintained between 84–29 psig. by recharging the system at frequent intervals. The number of required recharges totals fifteen. The heating bath is lowered and after cooling the reaction mixture the excess tetrafluorohydrazine is vented to the air. The reactor is degassed and opened to the air. Finally, the Aerosol tube with its contents is removed from the manifold and poured into a 100 ml. flask. The solvent is removed on a rotary stripper at reduced pressure. The residue weighs 13.7 g. (96% yield). The product is identified as 1,2,3-tris[1,2-bis-(difluoramino)ethoxy]-propane based on its infrared spectrum and elemental analysis. The product gives the following analysis:

Calculated for $C_9H_{14}F_{12}N_6O_3$: %C, 22.41; %H, 2.90; %F, 47.30; %N, 17.43. Found: %C, 23.03; %H, 3.03; %F, 47.46; %N, 17.17.

EXAMPLE II

The preparation of 1,2,3,-tris[1,2-bis(difluoramino)ethoxy]-propane from the static pressure reaction of 1,2,3l -trivinoxypropane in 1,1,2-trichloro-1,2,2-trifluoroethane (2.7 cc/g. olefin) with tetrafluorohydrazine is carried out in a Fisher-Porter high pressure glass reactor with magnetic stirring. There is used 2.7 cc. of 1,1,2-trichloro-1,2,2-trifluoroethane per gram of 1,2,3-trivinoxypropane.

The reaction is carried out in three stages, each varying in temperature, pressure, and duration. The initial stage is begun at ambient temperature (20°–30° C.) and an initial tetrafluorohydrazine pressure of not more than 100 psig. During this stage, the pressure drops off rapidly, as tetrafluorohydrazine is absorbed down to about 40 psig. before repressurizing with additional tetrafluorohydrazine. 1,2,3the initial pressure drop, the reactor is pressurized to a maximum of 125 psig. each time the pressure drops to 40–60 psig. No external heat is applied during this stage, but a slow exothermic heat of reaction is observed over a period of two to four hours causing a rise in temperature of 10°–15° C. During this time, 35 grams of 1,2,3-trivinoxypropane reacts. When the drop in pressure has almost stopped, this first stage is essentially over and moderate heating is applied. The temperature is maintained between 60°–65° C. for the second stage and a maximum pressure of 200 psig. is employed for repressurization with tetrafluorohydrazine each time the pressure drops to 125–135 psig. The duration of this stage is from 1.5 to 3 hours when 35 additional grams of 1,2,3-trivinoxypropane is used. Its completion is indicated, as in stage one, by a marked decrease in the rate of tetrafluorohydrazine absorption. The reaction is completed at 90°–100° C. and a maximum pressure of 300 psig. for repressurization when the pressure drops to 230 –240 psig. The reaction is complete when, after pressurization to 300 psig., there is no pressure drop. At this point, the reactor vessel is cooled to ambient temperature (about 25° C.) and vented. The excess $N_2F_4$ is removed at reduced pressure. The product, as in Example I, is identified as 1,2,3-tris[1,2-bis(difluoramino)ethoxy]-propane.

I claim:

1. A method for the preparation of 1,2,3-tris[1,2-bis(difluoramino)ethoxy]-propane which comprises reacting tetrafluorohydrazine and trivinoxypropane at a temperature of about 0° to about 120° C.

2. A method according to claim 1 wherein the reaction is conducted at a temperature range of about 20° to 100° C. in the presence of an inert volatile organic solvent.

3. A method according to claim 2 in which the reaction is conducted at pressures above atmospheric.

4. A method according to claim 2 in which the reaction is conducted at pressures below atmospheric.

5. A method according to claim 2 wherein the trivinoxypropane is added to the reaction system at a rate at which it substantially reacts.

* * * * *